US009211729B2

(12) United States Patent
Sasaki et al.

(10) Patent No.: US 9,211,729 B2
(45) Date of Patent: Dec. 15, 2015

(54) LIQUID EJECTING APPARATUS

(71) Applicant: SEIKO EPSON CORPORATION, Tokyo (JP)

(72) Inventors: Tsuneyuki Sasaki, Matsumoto (JP); Shuichiro Nakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/566,563

(22) Filed: Dec. 10, 2014

(65) Prior Publication Data

US 2015/0183233 A1 Jul. 2, 2015

(30) Foreign Application Priority Data

Dec. 27, 2013 (JP) ..... 2013-272554
Apr. 3, 2014 (JP) ..... 2014-076757

(51) Int. Cl.
*B41J 11/00* (2006.01)
*B41J 11/06* (2006.01)

(52) U.S. Cl.
CPC ..... *B41J 11/002* (2013.01); *B41J 11/06* (2013.01)

(58) Field of Classification Search
CPC ..... B41J 2/0057; B41J 2/01; B41J 2/17593; B41J 11/0065; B41J 11/007; B41J 11/0085; B41J 11/06; B41J 13/103; B41J 29/17; B41J 2002/012
USPC ..... 347/102–104
See application file for complete search history.

(56) References Cited

U.S. PATENT DOCUMENTS

| | | | | |
|---|---|---|---|---|
| 6,336,722 | B1 * | 1/2002 | Wotton et al. | 347/102 |
| 8,113,646 | B2 | 2/2012 | Elrod et al. | |
| 2002/0067401 | A1 * | 6/2002 | Yraceburu et al. | 347/102 |
| 2006/0077232 | A1 * | 4/2006 | Nakazawa | 347/55 |
| 2010/0225722 | A1 * | 9/2010 | Elrod et al. | 347/104 |
| 2011/0037819 | A1 * | 2/2011 | Mizutani | 347/108 |
| 2013/0050370 | A1 * | 2/2013 | Sasaki et al. | 347/102 |

FOREIGN PATENT DOCUMENTS

| | | |
|---|---|---|
| EP | 2832550 | 2/2015 |
| GB | 2357463 | 6/2001 |
| JP | 62-138248 | 6/1987 |
| JP | 2002-192707 | 7/2002 |
| JP | 2002-192711 | 7/2002 |
| JP | 2004-130705 | 4/2004 |
| JP | 2010-208325 | 9/2010 |
| JP | 2012-45855 | 3/2012 |
| JP | 2013-028093 | 2/2013 |

OTHER PUBLICATIONS

European Search Report for Application No. 14199844.3 dated Jun. 10, 2015.

* cited by examiner

*Primary Examiner* — Manish S Shah
*Assistant Examiner* — Roger W Pisha, II
(74) *Attorney, Agent, or Firm* — Workman Nydegger

(57) ABSTRACT

A liquid ejecting apparatus includes a medium support unit which has a supporting face for supporting a medium onto which liquid is ejected, and a heating unit which can heat liquid ejected onto the medium, in which the supporting face is configured of a member of which at least a part has thermal conductivity of equal to or smaller than 0.4 W/mK.

19 Claims, 6 Drawing Sheets

LIQUID EJECTING APPARATUS

BACKGROUND

1. Technical Field

The present invention relates to a liquid ejecting apparatus which includes a medium support unit which has a supporting face for supporting a medium onto which liquid is ejected, and a heating unit which can heat liquid from the side opposite to the supporting face for the medium in a state of being supported on the supporting face.

2. Related Art

In the related art, a liquid ejecting apparatus which causes ink to be fixed by heating a medium which is supported on a supporting face of a medium support unit is known as described in JP-A-2010-208325.

There is a description that an insulating platen with low thermal conductivity is used in a printer which is disclosed in JP-A-2010-208325.

However, materials, or parameters of the insulating platen are not mentioned in JP-A-2010-208325. That is, there is neither mention nor suggestion of effective heating of liquid which is ejected onto a medium using little thermal energy, and reducing damage to the medium when being heated.

SUMMARY

An advantage of some aspects of the invention is to possibly heat liquid which is ejected onto a medium, effectively, using little thermal energy.

According to an aspect of the invention, there is provided a liquid ejecting apparatus which includes a medium support unit which includes a supporting face for supporting a medium onto which liquid is ejected; and a heating unit which can heat the liquid which is ejected onto the medium, in which the supporting face is configured of a member of which thermal conductivity of at least a part is equal to or smaller than 0.4 W/mK.

According to the aspect, the medium support unit is a member in which at least a part of the member of the supporting face has thermal conductivity of equal to or smaller than 0.4 W/mK. Accordingly, thermal energy which is applied to the medium is hardly transmitted to the medium support unit in the supporting face which supports the medium by being in contact with the medium, and at a portion at which the thermal conductivity of equal to or smaller than 0.4 W/mK is low. Due to this, energy efficiency when heating the medium becomes good, and this leads to sufficient thermal energy, even when making the thermal energy which is output from the heating unit low. As a result, it is possible to efficiently heat the liquid which is ejected onto the medium with little thermal energy. In addition, it is possible to reduce damage to the medium which occurs when being heated.

In the liquid ejecting apparatus, the member may be present at at least a part of a portion of the supporting face which supports a region in the medium onto which the liquid is ejected.

According to the aspect, since the member with low thermal conductivity of equal to or smaller than 0.4 W/mK is present at at least a part of a portion of the supporting face which supports the region in the medium onto which the liquid is ejected, it is possible to effectively heat the liquid which is ejected onto the medium with less thermal energy.

In addition, it is possible to further reduce the damage to the medium which occurs when the medium is heated. In addition, this is specifically effective when the liquid is heated immediately after being ejected onto the medium.

In the liquid ejecting apparatus, the member may be present at at least a part of a portion of the supporting face which supports a region in the medium heated using the heating unit.

According to the aspect, since the member with the low thermal conductivity of equal to or smaller than 0.4 W/mK is present at at least a part of the portion of the supporting face which supports the region in the medium which is heated using the heating unit, it is possible to effectively heat the liquid which is ejected onto the medium with less thermal energy. In addition, it is possible to further reduce the damage to the medium which occurs when the medium is heated.

The liquid ejecting apparatus may further include a transport unit which transports the medium from an upstream side to a downstream side in a transport direction, in which the medium support unit may include a first configuration unit in which the member is present, and a second configuration unit which is located on the downstream side of the first configuration unit in the transport direction, and has higher thermal diffusivity than that of the first configuration unit.

According to the aspect, the medium support unit includes the second configuration unit which has higher thermal diffusivity than that of the first configuration unit on the downstream side in the transport direction of the first configuration unit in which the member with the thermal conductivity of equal to or smaller than 0.4 W/mK is present. Accordingly, when the heated medium is moved to the downstream side in the transport direction, the medium comes into contact with the second configuration unit which has high thermal diffusivity, and in which heat is easily transmitted.

In this manner, heat of the medium is diffused in the second configuration unit, and it is possible to maintain a temperature of the medium in a range of a temperature aimed for by suppressing a temperature rise of the medium.

In the liquid ejecting apparatus, a coefficient of water absorption of the member may be equal to or smaller than 0.2%.

When the member with the thermal conductivity of equal to or smaller than 0.4 W/mK absorbs water, the thermal conductivity thereof is changed due to an influence of the absorbed water. According to the aspect, since the coefficient of water absorption of the member with the thermal conductivity of equal to or smaller than 0.4 W/mK is equal to or smaller than 0.2%, it is possible to suppress a change in thermal conductivity due to the absorption of water, and it is possible to maintain the original function of the member which can effectively heat the liquid ejected onto the medium with little thermal energy.

In the liquid ejecting apparatus, a coefficient of dynamic friction of the member may be equal to or smaller than 0.4.

According to the aspect, since it is possible to suppress a transport resistance of the medium to be low, damage to the medium in a state of being heated in a transporting process can be reduced.

In the liquid ejecting apparatus, a heat-resistant temperature of the member may be equal to or greater than 150° C.

According to the aspect, it is possible to suppress thermal deformation of the member with the thermal conductivity of equal to or smaller than 0.4 W/mK.

In the liquid ejecting apparatus, a thickness of the member may be equal to or greater than 2 mm.

According to the aspect, since the thickness of the member with the thermal conductivity of equal to or smaller than 0.4 W/mK is equal to or greater than 2 mm, it is possible to stabilize thermal insulation of the member with the thermal conductivity of equal to or smaller than 0.4 W/mK.

In the liquid ejecting apparatus, bending strength of the member may be equal to or greater than 50 MPa.

According to the aspect, it is possible to make bending deformation of the member with the thermal conductivity of equal to or smaller than 0.4 W/mK difficult.

In the liquid ejecting apparatus, compressive strength of the member may be equal to or greater than 50 MPa.

According to the aspect, it is possible to make compressive deformation of the member with the thermal conductivity of equal to or smaller than 0.4 W/mK difficult.

In the liquid ejecting apparatus, the member may be formed by laminating a sheet-shaped material which includes a heat curable resin, balloons, and a fiber reinforcing material.

According to the aspect, it is possible to easily secure thermal insulation and strength of the member with the thermal conductivity of equal to or smaller than 0.4 W/mK using the laminated structure of the sheet-shaped material.

In the liquid ejecting apparatus, a suction hole for causing a suction force to work on the medium may be provided on the supporting face of the medium support unit.

Since the medium is heated when being pushed to the suction hole, the medium is drawn into the suction hole according to a degree of thermal energy at the time of the heating, and there is a concern of being damaged.

According to the aspect, since it is possible to effectively heat the liquid which is ejected toward the medium using little thermal energy, it is effective when applying any one, or more of each aspect with respect to the liquid ejecting apparatus which includes the medium support unit with a structure of including the suction hole.

In the liquid ejecting apparatus, the heating unit may heat the liquid ejected onto the medium so as to have a temperature of 35° C. to 60° C. In this manner, it is possible to sufficiently dry the liquid which is ejected onto the medium.

In the liquid ejecting apparatus, the heating unit may heat the liquid which is ejected onto the medium so as to have a temperature of 40° C. to 55° C. In this manner, it is possible to sufficiently dry the liquid which is ejected onto the medium.

The liquid ejecting apparatus may further include an ejecting unit which ejects the liquid, in which the heating unit may heat the liquid which is ejected onto the medium so as to be at equal to or lower than a heat-resistant temperature of the ejecting unit. In this manner, it is possible to heat the liquid without causing a malfunction of the ejecting unit.

In the liquid ejecting apparatus, the heating unit may heat the liquid which is ejected onto the medium by radiating electromagnetic waves including a wavelength of at least 2.0 μm to 6.0 μm. In this manner, it is possible to effectively heat the liquid.

The liquid ejecting apparatus may further include a blower unit which sends wind to the liquid which is ejected onto the medium. In this manner, it is possible to dry the liquid which is ejected onto the medium.

In the liquid ejecting apparatus, the blower unit may send wind with an air velocity of 1.0 m/sec to 4.0 m/sec to the liquid which is ejected onto the medium. In this manner, it is possible to dry the liquid while suppressing flight bending of the liquid which is ejected from the ejecting unit.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment (Refer to FIGS. 1 to 6)

Hereinafter, a liquid ejecting apparatus according to an embodiment of the invention will be described in detail with reference to accompanying drawings.

First, (1) a schematic configuration of the liquid ejecting apparatus according to the embodiment will be described, and (2) a configuration and an operation form of a medium support unit which is a main part of the invention will be described in detail.

Figure 1:
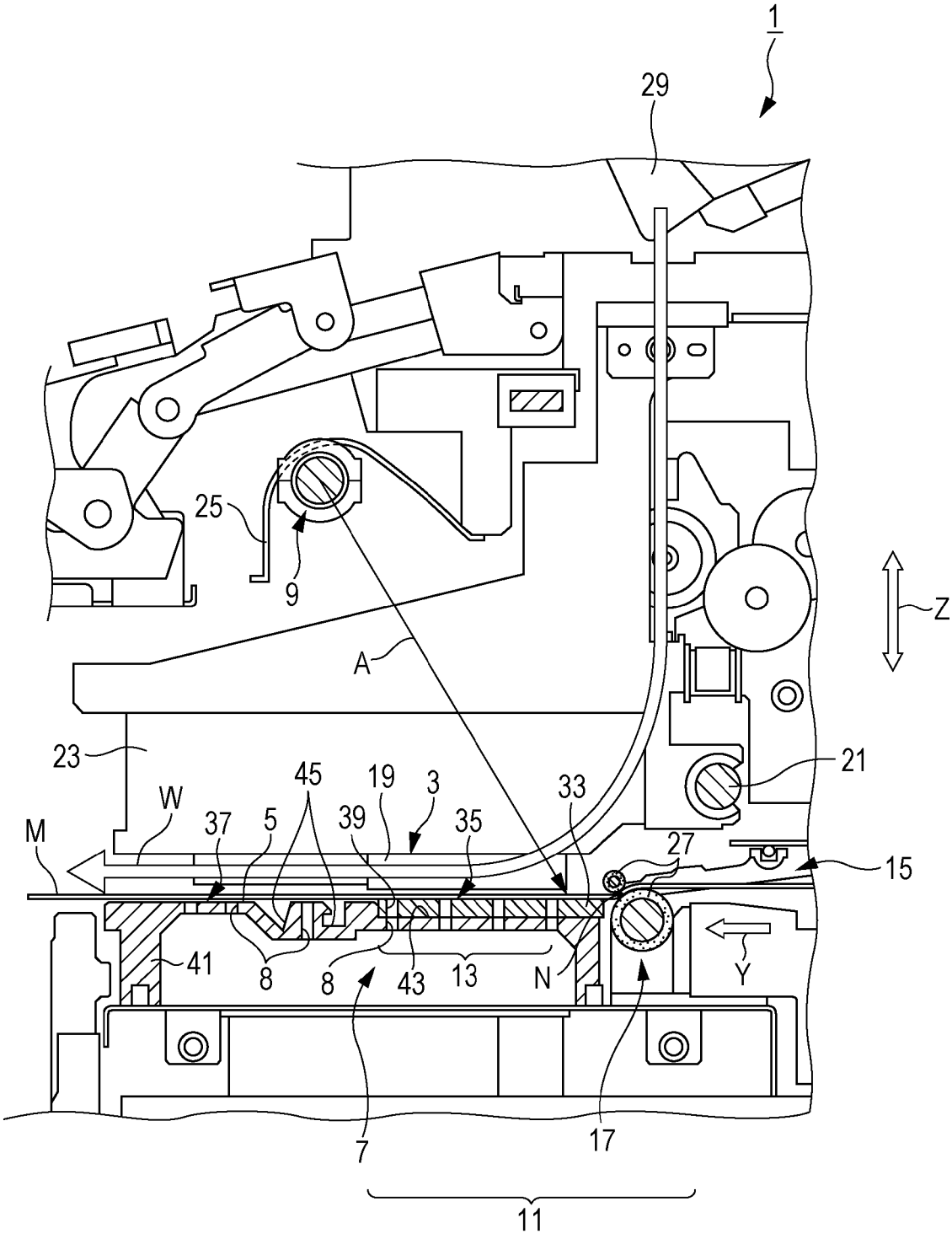
FIG. 1 is a cross-sectional side view which illustrates a liquid ejecting apparatus according to an embodiment of the invention.
Figure 2:
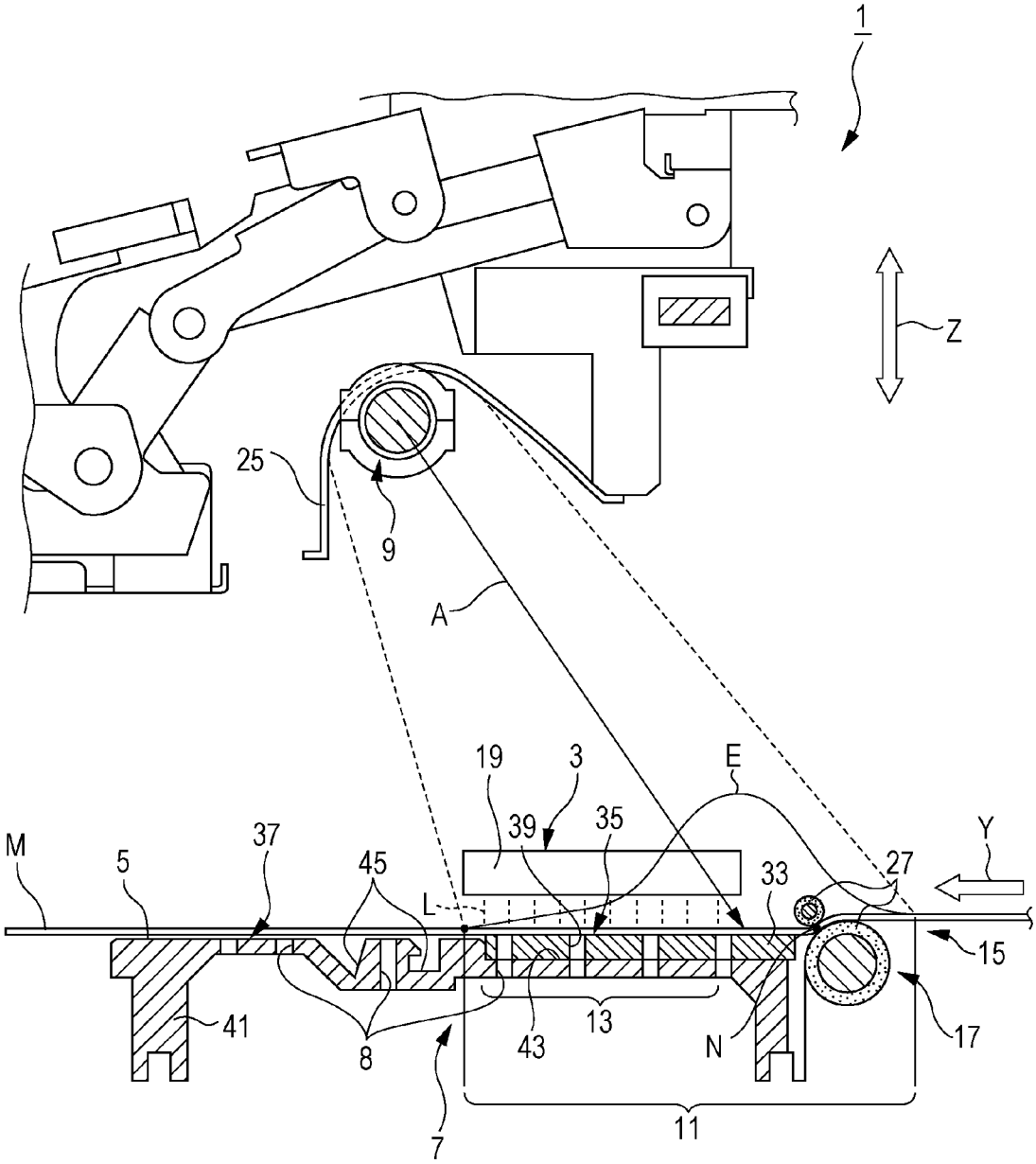
FIG. 2 is an enlarged cross-sectional side view of a main part which illustrates the liquid ejecting apparatus according to the embodiment of the invention.

(1) Schematic Configuration of Liquid Ejecting Apparatus (Refer to FIGS. 1 and 2)

A liquid ejecting apparatus 1 according to one embodiment of the invention is basically configured by a medium support unit 7 including a supporting face 5 which supports a medium M onto which liquid L is ejected, and a heating unit 9 which can heat the liquid L from the side opposite to the supporting face 5 of the medium M which is in a state of being supported by the supporting face 5. In other words, the liquid ejecting apparatus 1 includes the heating unit 9 which can heat the liquid L which is ejected onto the medium M.

Here, the heating unit 9 which heats a target by radiating electromagnetic waves A such as infrared light toward the target is described as an example, however, there is no limitation to this. That is, the heating unit 9 may be a unit which can heat the liquid L from the side opposite to the supporting face 5 with respect to the medium M in a state of being supported by the supporting face 5.

In addition, at least a part of the medium support unit 7 on the supporting face 5 is configured using a member 33 with a thermal conductivity of equal to or smaller than 0.4 W/mK. A specific material of the member 33 will be described later.

The liquid ejecting apparatus 1 according to the embodiment is an ink jet printer with a configuration which uses the heating unit 9 which radiates electromagnetic waves A such as infrared light as an example, and includes a transport unit 17 which transports the medium M from the upstream side to the downstream side in the transport direction Y.

Accordingly, the liquid L according to the embodiment is ink, and has a property in which a liquid component in ink is heated and dried due to radiant heat of the electromagnetic waves A, and a coloring material (pigment, dyes, or the like) in ink on the surface of the medium M is fixed.

In addition, the liquid ejecting apparatus 1 includes an ejecting unit 3 which ejects the liquid L. The ejecting unit 3 includes a liquid ejecting head 19 which ejects the liquid L, and a carriage 23 which reciprocates in the width direction X which intersects the transport direction Y of the medium M as the scanning direction, along a carriage guide axis 21 in a state in which the liquid ejecting head 19 is mounted on the lower face as an example.

In addition, as a material of the medium M, it is possible to use paper, a vinyl chloride resin, cloth (fabric of cotton, linen, silk), or the like. At this time, it is possible to use materials with a variety of thickness, as the thickness. In addition, a disc such as a CD, a DVD, or the like, may be used as the medium M.

In addition, the medium support unit 7 is a support member of the medium M which is provided at a position facing an ejecting face of the liquid ejecting head 19, and takes a role of defining a gap between the supporting face 5 of the medium support unit 7 and the ejecting face of the liquid ejecting head 19.

In addition, as will be described later, the medium support unit 7 becomes a characteristic component member.

As described above, electromagnetic waves A are directly radiated to the medium M on the supporting face 5 from the heating unit 9, however, they are indirectly radiated to the medium M on the supporting face 5 through a reflector 25 which is a reflective plate. As the electromagnetic waves A, light such as infrared light, far infrared light, and visible light which can generate radiant heat in a radiation target is used. According to the embodiment, infrared light is used as an example, and an infrared heater is used as the heating unit 9.

In addition, the transport unit 17 includes a medium transport path 15 which is formed inside the liquid ejecting apparatus 1, a guide member such as a guide roller (not illustrated) which guides transporting of the medium M on the medium transport path 15, a suction member (not illustrated) which adsorbs and retains the medium M using a plurality of suction holes 8 which are formed on the supporting face 5 of the medium support unit 7, and a member for transporting the medium M which includes a pair of nip rollers 27 which sends the medium M into a gap between the liquid ejecting head 19 and the medium support unit 7.

In addition, according to the embodiment, a drying fan as a blower unit 29 which sends wind W toward the downstream side from the upstream side in the transport direction Y of the medium M using the transport unit 17 is provided at the upper position of an irradiation region 11 in the height direction Z as illustrated in FIG. 1 with respect to the irradiation region (heated region) 11 of the electromagnetic waves A with respect to the medium M on the supporting face 5.

In addition, a plurality of the blower units 29 are provided along the width direction X, and it is possible to perform air blowing in a linear manner along the width direction X. In addition, in a region in which the carriage 23 is present, the wind W is blocked by the carriage 23. Accordingly, the blower unit 29 takes a role of causing the wind W to flow as denoted by an arrow in FIG. 1 with respect to an empty region other than the region in which the carriage 23 is present in the width direction X, and prompting drying of the liquid L which is ejected onto the medium M.

(2) Configuration and Operation of Medium Support Unit (Refer to FIGS. 1 to 4)

As described above, in the liquid ejecting apparatus 1 according to the embodiment, at least a part of the medium support unit 7 on the supporting face 5 is configured of a member with thermal conductivity of equal to or smaller than 0.4 W/mK (hereinafter, referred to as "low thermal conductivity member") 33.

Figure 3:
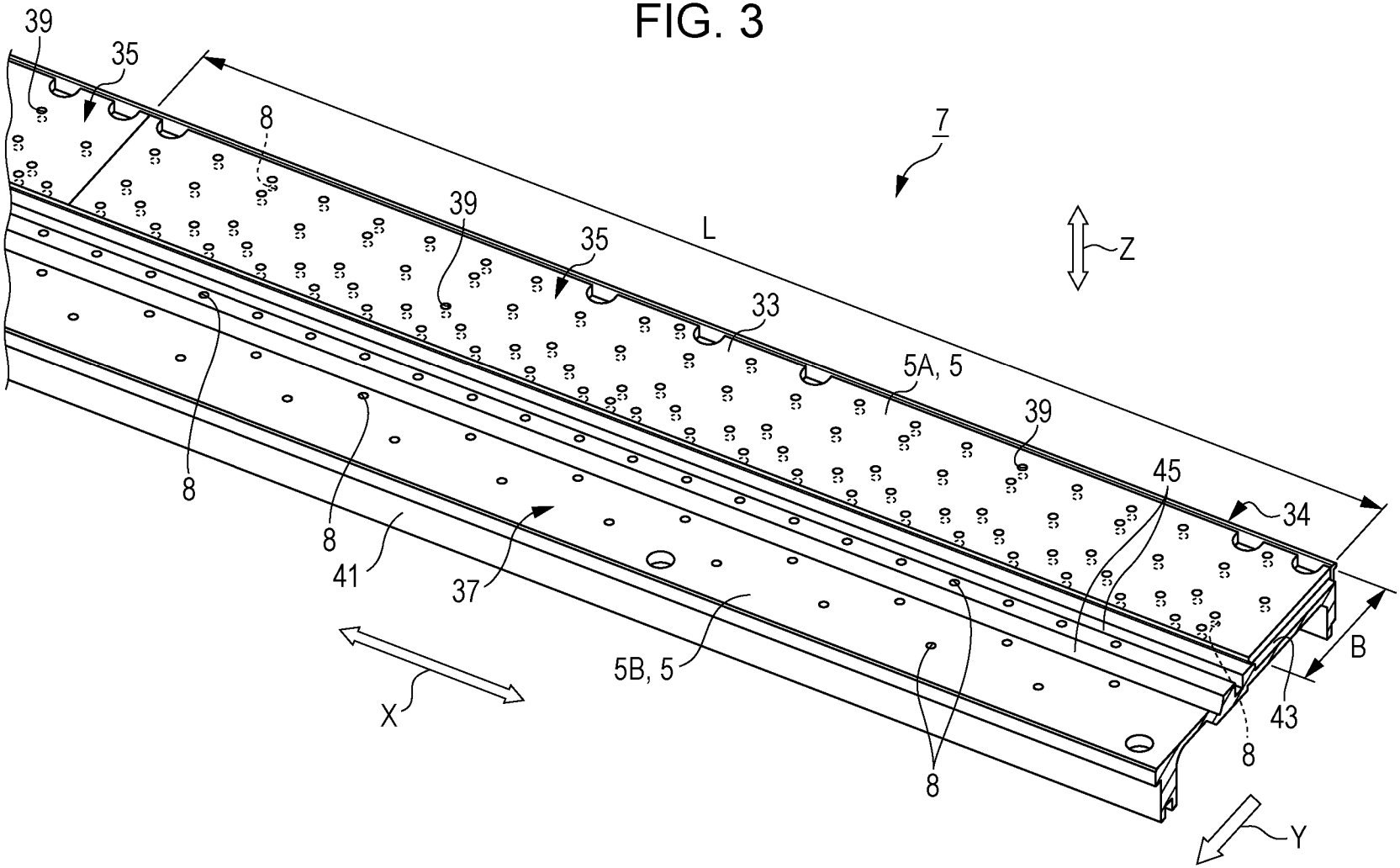
FIG. 3 is a perspective view which illustrates a medium support unit of the liquid ejecting apparatus according to the embodiment of the invention.
Figure 4:
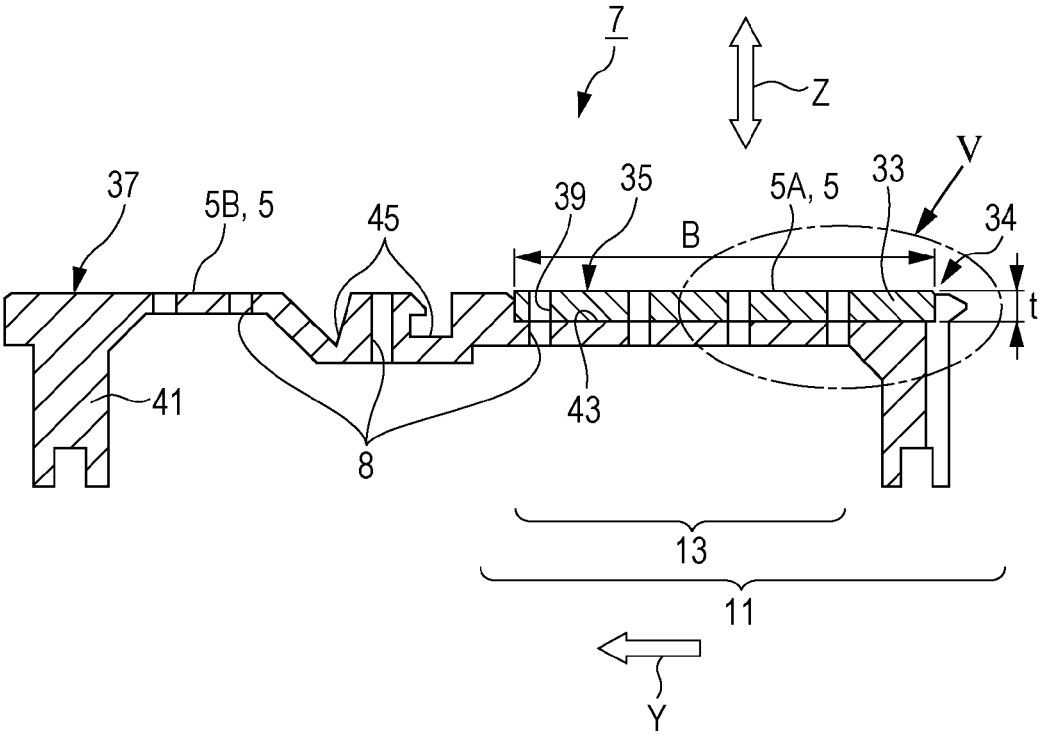
FIG. 4 is a cross-sectional side view which illustrates the medium support unit of the liquid ejecting apparatus according to the embodiment of the invention.

In addition, according to the embodiment, a main body unit 41 of the medium support unit 7 has a uniform cross-sectional shape as illustrated in FIG. 4, and is configured of an aluminum frame member as an example, which is long in the width direction X as illustrated in FIG. 3.

Figure 7:
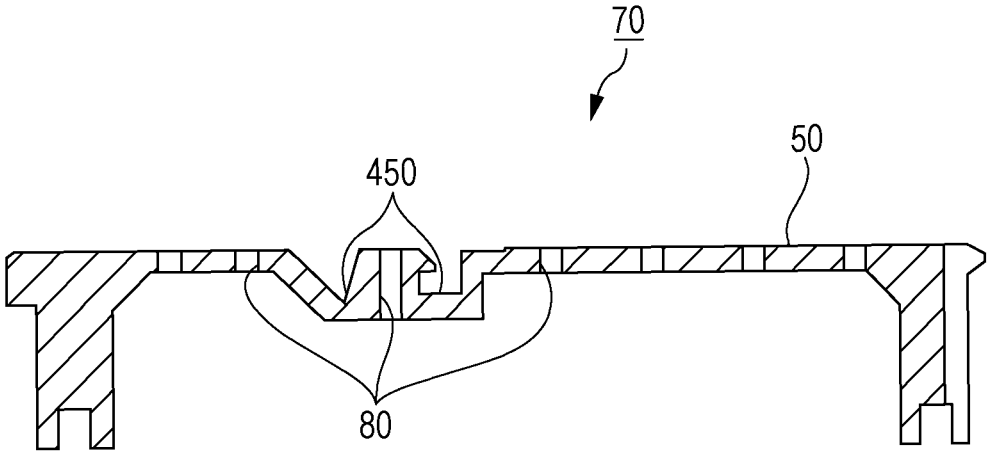
FIG. 7 is a cross-sectional side view which illustrates a medium support unit of a liquid ejecting apparatus in the related art.

FIG. 7 illustrates a medium support unit 70 in the related art. The medium support unit 70 in the related art includes a supporting face 50, a suction hole 80, and a reading groove portion 450, however, there is no low thermal conductivity member 33 which is described above.

According to the embodiment, a concave portion 43 which accommodates the low thermal conductivity member 33 is formed in the main body unit 41 of the medium support unit 7, and the low thermal conductivity member 33 is attached to the concave portion 43.

In addition, two reading groove portions 45 for accommodating a sensor (not illustrated) which is used when detecting a position of the medium M, or the like, are provided as an example, along the width direction X on the downstream side of the concave portion 43 in the transport direction Y.

The thermal energy which is provided to the medium M from the heating unit 9 in order to dry the liquid L is transmitted to the supporting face 5 which supports the medium M, however, when there is a low thermal conductivity member 33 on the supporting face 5, the thermal energy is hardly transmitted to the medium support unit 7 compared to a structure in which the low thermal conductivity member 33 is not present. That is, the thermal energy is hardly transmitted to the medium support unit 7 to the inside of the supporting face 5 which supports the medium M by being in contact with the medium M, and to a portion of the low thermal conductivity member 33. That is, the thermal energy hardly escapes to the medium support unit 7 to the inside of the supporting face 5 which supports the medium M by being in contact with the medium M, and to a portion of the low thermal conductivity member 33.

In this manner, energy efficiency at the time of heating the medium M becomes good, and the thermal energy which is output from the heating unit 9 is sufficient, even when reducing the thermal energy. As a result, it is possible to effectively heat the liquid L which is ejected onto the medium M using little thermal energy. In addition, it is possible to reduce damage to the medium M which occurs when the medium is heated.

Subsequently, at which portion of the medium support unit 7 the low thermal conductivity member 33 is provided will be described.

Regarding Ejection Region

In addition, according to the embodiment, there is configuration such that the low thermal conductivity member 33 is present at at least a part of a portion supporting an ejection region 13 on the medium M in which the liquid L is ejected, on the supporting face 5. "Present at at least a part" means that the low thermal conductivity member may be present at the entire ejection region 13, or may be present at a part thereof. In the example which is illustrated in the figure, the low thermal conductivity member 33 is provided at approximately the whole region of the ejection region 13, and at a portion on the downstream side of the ejection region 13 in the transport direction Y.

Since the ejection region 13 is a region in which the liquid L is ejected onto the medium M, a large amount of thermal energy is applied from the heating unit 9 in order to dry the liquid. According to the embodiment, since there is the low thermal conductivity member 33 at a portion at which such a large amount of thermal energy is provided, it is possible to effectively reduce the amount of thermal energy which is transmitted to the medium support unit 7. In this manner, it is possible to effectively heat the liquid L which is ejected onto the medium M using less thermal energy.

In addition, the structure is particularly effective in the liquid ejecting apparatus 1 with a structure in which the liquid L is heated immediately after being ejected onto the medium M.

With Respect to Heated Region

In addition, the low thermal conductivity member 33 may be configured from a viewpoint of the member being present at at least a part of a portion supporting the heated region 11 on the medium M which is heated using the heating unit 9, on the supporting face 5. "Present at at least a part" means that the member may be present in the entire heated region 11, or may be present at a part thereof.

In FIG. 2, a mark E denotes a distribution of the thermal energy which is applied to the medium M. According to the embodiment, this is set such that a peak position of the thermal energy E comes at around the upstream end of the irradiation region 11 in the transport direction Y. In addition, the low thermal conductivity member 33 is provided so as to be present at a part of the heated region 11 as illustrated in FIG. 2.

A large amount of thermal energy is applied to the heated region 11 from the heating unit 9. Also in the structure according to the viewpoint, it is possible to effectively reduce a transmission amount of the thermal energy to the medium support unit 7, since there is the low thermal conductivity member 33 at the portion to which the large amount of thermal energy is applied. In this manner, it is possible to effectively heat the liquid L which is ejected onto the medium M using less thermal energy.

That is, the low thermal conductivity member 33 may be provided at at least a part on the supporting face 5 which is present in the ejection region 13 or the heated region 11.

Accordingly, in the embodiment, as illustrated in FIGS. 1 to 4, the medium support unit 7 includes the first configuration unit 35 in which the low thermal conductivity member 33 is present, and the second configuration unit 37 which is located on the downstream side of the first configuration unit 35 on the supporting face 5 in the transport direction Y, and of which thermal diffusivity is higher than that of the first configuration unit 35. Here, thermal diffusivity of a material body is obtained by dividing the thermal diffusivity of the material body by a product of density and specific heat. In addition, the thermal diffusivity is also referred to as temperature conductivity.

A specific material of the second configuration unit 37 may be a material with higher thermal diffusivity than that of the first configuration unit 35, and is not limited to a specific material, however, as described above, aluminum which is adopted as a material of the main body unit 33 is a material with high thermal diffusivity which is preferable, as the material of the second configuration unit 37. In addition, the second configuration unit 37 is particularly preferable when the unit has higher thermal conductivity than that of the first configuration unit 35. The reason for this is that, when the thermal conductivity becomes higher, the thermal diffusivity also becomes higher in proportion to the thermal conductivity.

In this manner, when the heated medium M moves to the downstream side in the transport direction Y, the medium comes into contact with the second configuration unit 37 in which the thermal diffusivity is high, and to which heat is easily transmitted. Accordingly, the heat of the medium M is diffused to the second configuration unit 37, and it is possible to maintain a temperature of the medium M in an attempted temperature range by suppressing a temperature rise of the medium M.

In addition, according to the embodiment, as the low thermal conductivity member 33, a member with a coefficient of water absorption of equal to or smaller than 0.2% is used.

When the low thermal conductivity member 33 absorbs water, thermal conductivity thereof is changed due to an influence of the absorbed water. According to the embodiment, since the coefficient of water absorption of the low thermal conductivity member 33 is equal to or smaller than 0.2%, it is possible to be suppressed in a range in which the influence of the change in thermal conductivity due to water absorption is small, and to maintain the original function of the low thermal conductivity member 33 in which liquid L which is ejected onto the medium M can be effectively heated using little thermal energy.

In addition, according to the embodiment, it is desirable that a coefficient of dynamic friction of the low thermal conductivity member 33 be equal to or smaller than 0.4. Since it is possible to suppress a transport resistance of the medium due to this, damage in the transporting process to the heated medium M can be reduced. In addition, it is possible to prevent the medium M from being hooked and stuffed. When the medium M is stuffed, and transporting of the medium is stopped, a specific portion of the medium M is excessively heated, and is seriously damaged, however, when the coefficient of dynamic friction is equal to or smaller than 0.4, it is possible to reduce such a risk.

In addition, it is desirable that a heat-resistant temperature of the low thermal conductivity member 33 be equal to or greater than 150° C. Due to this, it is possible to suppress thermal deformation of the low thermal conductivity member 33.

In addition, it is desirable that the thickness of the low thermal conductivity member 33 be equal to or greater than 2 mm. When the thickness becomes large, mass of the low thermal conductivity member 33 also increases along with the thickness. Accordingly, a thermal capacity of the low thermal conductivity member 33 increases, and a temperature fluctuation hardly occurs. In this manner, it is possible to stabilize thermal insulation of the low thermal conductivity member 33. In addition, the thermal capacity is obtained from the product of mass (product of volume and density) and specific heat of a material body.

In addition, it is desirable that bending strength of the low thermal conductivity member 33 be equal to or greater than 50 MPa. Due to this, it is possible to make bending deformation of the low thermal conductivity member 33 difficult.

In addition, it is preferable for the low thermal conductivity member 33 to have compressive strength of equal to or greater than 50 MPa. Due to this, it is possible to make compressive deformation of the low thermal conductivity member 33 difficult.

As a material satisfying each condition which is described above, it is possible to use a material in which a sheet-shaped material including a heat curable resin, balloons, and a fiber reinforcing material is laminated, as an example. Here, the balloons are fine particles including foaming air which is added as a filler of a binder, in order to reduce weight of a laminated plate which is formed of the heat curable resin and the fibered reinforcing material, and as the balloon, an organic balloon and an inorganic balloon are known. That is, the balloon is a filler with low specific gravity.

As the heat curable resin which is used here, as an example, it is possible to use a phenol resin, an epoxy resin, a silicone resin, a polyester resin, a melamine resin, a heat curable polyimide resin, or the like, independently. In addition, a plurality of types of these resins may be mixed.

In addition, as the balloons, it is possible to apply a synthetic resin of which a specific weight is approximately 0.05 to 0.70, cellulose, inorganic balloons other than these, shirasu, glass, alumina, and organic balloons other than these, as an example.

In addition, as the fibered reinforcing material, it is possible to apply a material in which inorganic fibers such as glass fibers, carbon fibers, rock wool, and metal fibers, or whiskers, cotton, linen, and natural fibers other than these, and organic fibers which are formed of synthetic fibers are processed into a sheet shape, as an example.

Specifically, as the low thermal conductivity member 33, a product name of "KALLYTE" manufactured by Nikko Kasei Co., Ltd. which is formed by welding and molding these materials using hot pressing can be preferably used. In addition, it is also possible to use BMC (glass epoxy), or the like, other than this.

Figure 5:
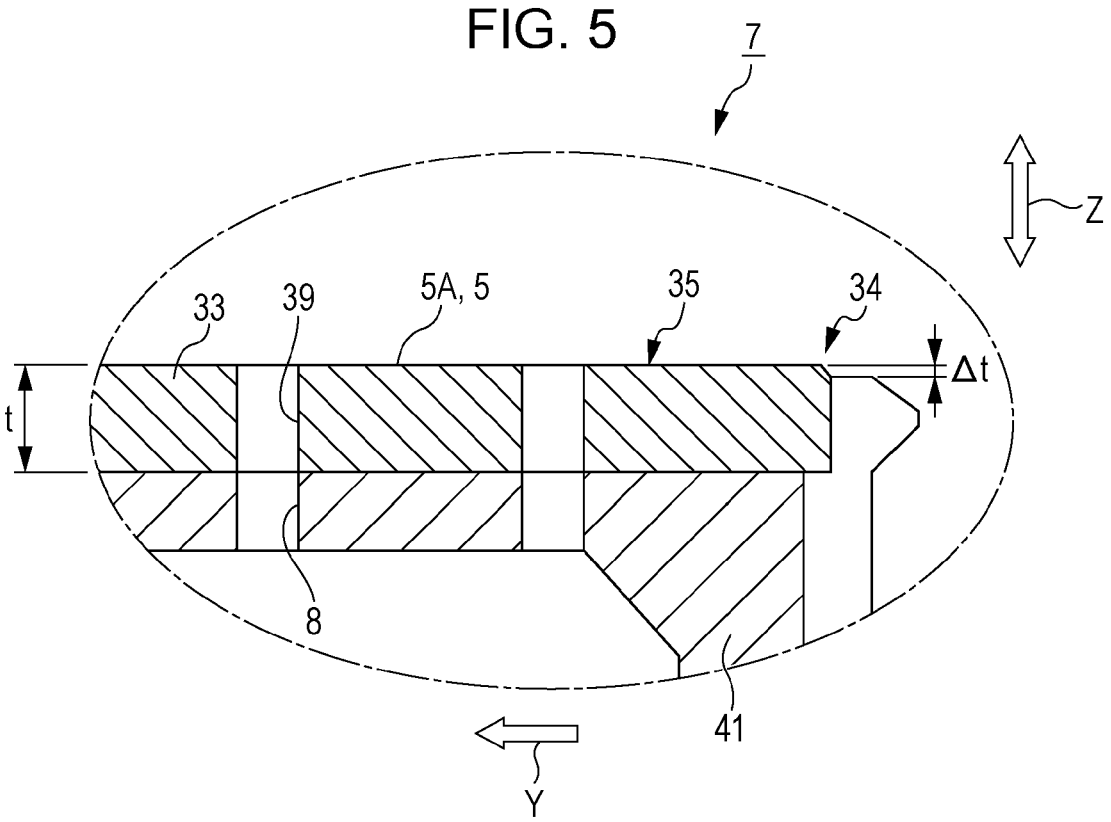
FIG. 5 is an enlarged cross-sectional side view of portion V in FIG. 4 which illustrates the medium support unit of the liquid ejecting apparatus according to the embodiment of the invention.

In addition, as illustrated in FIG. 5, according to the embodiment, the supporting face 5A which is configured of the low thermal conductivity member 33 is higher than the other supporting face 5B of the medium support unit 7 by a dimension Δt. In addition, a chamfering process is performed with respect to a step portion 34 on the upstream side of the low thermal conductivity member 33 in the transport direction Y.

Incidentally, a convection state of the dimension Δt is provided so that, when the medium M passes through the first configuration unit 35, the medium reliably comes into contact with the supporting face 5 of the low thermal conductivity member 33, and the insulation operation of the low thermal conductivity member 33 is exerted. In addition, the reason why the chamfering process is performed with respect to the step portion 34 is to execute smooth transport of the medium M by suppressing hooking of the medium M on the step portion 34.

In addition, according to the embodiment, the maximum step difference (approximately 0.2 mm) in the width direction X is taken into consideration, and a chamfering process of C0.5 is performed with respect to the step portion 34 by setting the dimension Δt to 0.5 mm, as an example.

In addition, according to the embodiment, as the outer dimensions of the low thermal conductivity member 33, the width B is set to 60 mm, the length L is set to 600 mm, and the thickness is set to 5 mm, as an example. In addition, three low thermal conductivity members 33 are aligned in the width direction X with respect to one liquid ejecting apparatus 1, and are used.

In addition, as an example, a plurality of holes 39 with a diameter of approximately 3 mm are formed on the supporting face 5A of the low thermal conductivity member 33. The hole 39 is configured so as to exert a desired suction operation with respect to the medium M by communicating with the suction hole 8 which is formed in the main body unit 41 of the medium support unit 7. The hole 39 and the suction hole 8 may communicate with each other, and the hole cores may not match with each other, as illustrated. In addition, both the hole diameters may not be the same, as illustrated. In addition, the plurality of holes 39 may not be necessary.

In addition, the plurality of suction holes 8 are provided at appropriate intervals over a scanning range of the carriage 23 in the width direction X, on the base of the concave portion 43, on the supporting face 5B between two reading groove portions 45 and 45, and on the supporting face 5B on the downstream side of the two reading groove portions 45 and 45 in the transport direction Y.

Subsequently, operations and effects of the liquid ejecting apparatus 1 according to the embodiment will be described based on FIGS. 2 and 6. The medium M to which a transport force is applied using the nip roller 27 reaches the ejection region 13 on the lower part of the liquid ejecting head 19 from the nipping point N, and desired recording is performed when ink as the liquid L is ejected.

In addition, the heated region 11 is provided in a form of including the ejection region 13, radiant heat is generated when the electromagnetic waves A which are radiated from the heating unit 9 are radiated to the liquid L which is ejected toward the medium M existing in the ejection region 13, and in this manner, the liquid L is heated.

At this time, the first configuration unit 35 in which the low thermal conductivity member 33 is present is provided on the lower part of the medium M which passes through the ejection region 13 or the heated region 11. For this reason, due to the insulation operation of the first configuration unit 35, the thermal energy E illustrated in FIG. 2 which is applied to the medium M is hardly transmitted into the medium support unit 7.

In this manner, it is possible to effectively heat the liquid L which is ejected onto the medium M using little thermal energy E, and to reduce power consumption of the heating unit 9.

Figure 6:
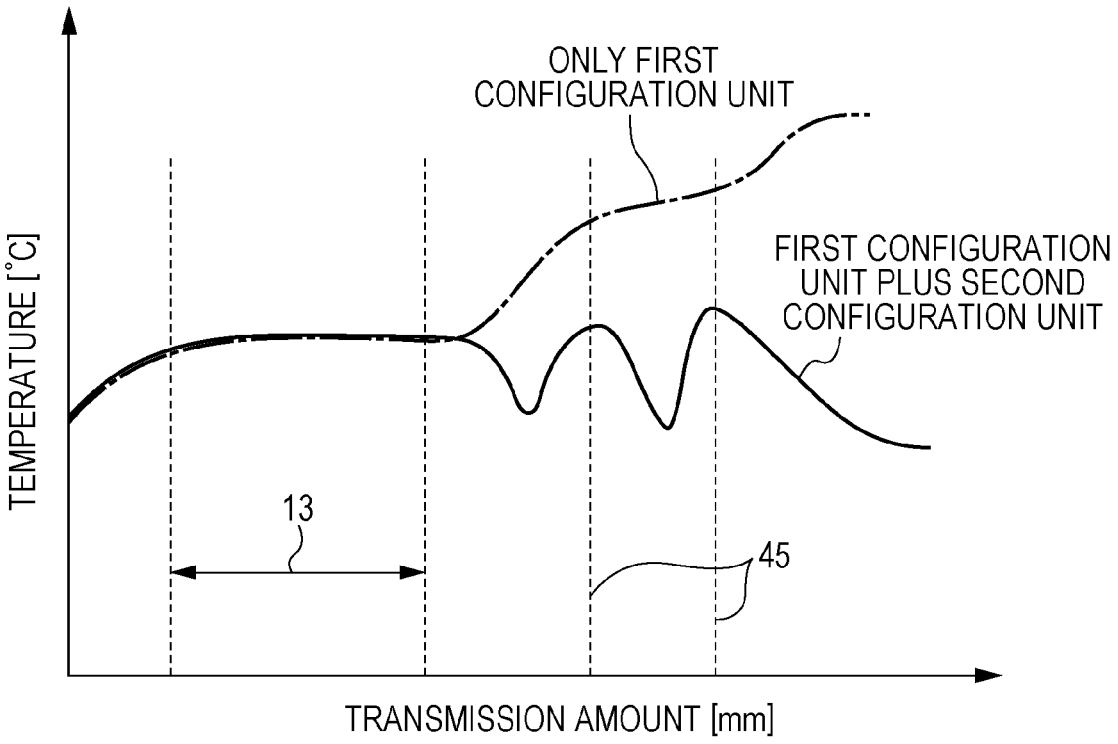
FIG. 6 is a graph which denotes an effect of the liquid ejecting apparatus according to the embodiment of the invention.

In addition, a temperature of the medium M which passes through from the ejection region 13 to the heated region 11 is suppressed to be low so as to be approximately 50° C., constantly, as illustrated in FIG. 6, and as a result, it is possible to prevent clogging of the nozzle by suppressing a temperature rise on the ejection face of the liquid ejecting head 19.

When the medium M is transported to the downstream side in the transport direction Y by passing through from the ejection region 13 to the heated region 11, a temperature rise of the medium M is suppressed as denoted by a solid line in FIG. 6, due to a thermal diffusing operation of the second configuration unit 37, and it is possible to suppress temperature rises in a housing of the liquid ejecting apparatus 1, in the carriage 23, and on the ejection face of the liquid ejecting head 19.

Incidentally, since a temperature of the medium M continuously rises when the second configuration unit 37 is not provided, as denoted by a one dot-dashed line in FIG. 6, damage occurs to the medium M, and damage occurs in each component configuring the liquid ejecting apparatus 1 due to the temperature rise in the housing of the liquid ejecting apparatus 1, and as a result, there is a concern that adverse effects on performance and lifespan of a product may be brought about.

In contrast to this, according to the embodiment, since heat is radiated to the outside due to the heat diffusion operation of the second configuration unit 37, the temperature rise in the medium M, the housing, and the components is suppressed, the damage to the medium M, each of the components, or the like, is reduced, and it is possible to improve reliability of a product.

In other words, by providing a hybrid structure of the first configuration unit 35 and the second configuration unit 37 to the medium support unit 7, it is possible to reduce thermal damage to the medium M or liquid ejecting apparatus 1, while increasing heating efficiency of a heating target.

Other Embodiment

The liquid ejecting apparatus 1 according to the embodiment basically has the above described configuration, however, as a matter of course, it is possible to perform a change to or omission of a partial configuration without departing from the scope of the invention.

For example, the low thermal conductivity member 33 which is provided on the supporting face 5 of the medium support unit 7 is provided over the entire range of the above described ejection region 13 to heated region 11 so as to include all thereof, and it is also possible to provide the low thermal conductivity member at a part of the range thereof, for example, the plurality of low thermal conductivity members may be arranged in a state of being separated with appropriate intervals in the width direction X, or in the transport direction Y.

In addition, the outer dimension and the number of the low thermal conductivity members 33 which is used, which are exemplified in descriptions of the embodiment, or each value denoting the characteristics is an example, and can be appropriately changed according to a size of the liquid ejecting apparatus 1, a type of the medium M which is used, and differences in a shape of the medium support unit 7, or the like.

Supplementary Items According to Embodiment

Detailed conditions of the above described embodiment will be supplemented below.

As described above, a temperature of the medium M which passes through from the ejection region 13 to the heated region 11 is suppressed to be approximately 50° C. as illustrated in FIG. 6. To supplement this, the temperature of approximately 50° C. may be a range of 35° C. to 60° C. In addition, it is more preferable to be a temperature of 40° C. to 55° C. When there is a temperature at this level, it is possible to sufficiently dry the liquid L which is ejected onto the medium M. That is, the liquid L is fixed onto the medium M to an extent of not being blurred, or extended by being rubbed.

As a conclusion, the heating unit 9 heats a temperature of the liquid L which is ejected onto the medium M so as to be 35° C. to 60° C. More preferably, the heating unit 9 heats the liquid L which is ejected onto the medium M so as to be a temperature of 40° C. to 55° C.

At this time, since the low thermal conductivity member 33 is provided in the medium support unit 7, it is possible to reduce thermal energy for heating the liquid L which is ejected onto the medium M to a desired temperature. Accordingly, it is particularly preferable to use the low thermal conductivity member 33 when being such a heating condition.

In addition, the heat-resistant temperature of the ejecting unit 3 is usually about 60° C. According to the embodiment, when exceeding the heat-resistant temperature, there is a possibility that malfunction such as clogging of the liquid L in the nozzle of the liquid ejecting head 19 may occur. A heating target of the heating unit 9 is the liquid L which is ejected onto the medium M, however, the ejecting unit 3 is also heated using the heating unit 9. That is, the temperature of the ejecting unit 3 becomes close to the temperature of the liquid L which is ejected onto the medium M. Accordingly, the heating unit 9 heats the liquid L which is ejected onto the medium M so as to have a temperature of equal to or lower than the heat-resistant temperature of the ejecting unit 3. In this manner, it is possible to heat the liquid L without causing malfunction of the ejecting unit 3. In addition, since the heat-resistant temperature is different depending on the configuration of the ejecting unit 3, it is not limited to 60° C.

At this time, since the low thermal conductivity member 33 is provided in the medium support unit 7, it is possible to reduce the energy for heating the liquid L which is ejected onto the medium M. Accordingly, it is possible to suppress unnecessary heating of the ejecting unit 3, and to prevent malfunction of the ejecting unit 3 from occurring.

In addition, the heating unit 9 can sufficiently dry the liquid L which is ejected onto the medium M, and it is particularly preferable when performing heating so as not to cause malfunction of the ejecting unit 3.

In addition, according to the embodiment, as described above, the heating unit 9 uses infrared light. At this time, specifically, infrared light which has a maximum wavelength in a bandwidth of 2.0 μm to 6.0 μm is used. The wavelength in the bandwidth of 2.0 μm to 6.0 μm performs a remarkable heating operation with respect to molecules of water. In addition, the liquid L according to the embodiment contains water. Accordingly, when the infrared light which has the maximum wavelength in the bandwidth of 2.0 μm to 6.0 μm is used, it is possible to effectively heat the liquid L. In addition, the infrared light used in heating may have a wavelength in another bandwidth. In addition, it is preferable to change the maximum wavelength of the infrared light according to a solvent which is contained in the liquid L.

As a conclusion, the heating unit 9 heats the liquid L which is ejected onto the medium M by radiating the electromagnetic waves A which includes a wavelength of at least 2.0 μm to 6.0 μm.

At this time, since the low thermal conductivity member 33 is provided in the medium support unit 7, it is possible to reduce the energy for heating the liquid L which is ejected onto the medium M. Accordingly, when the low thermal conductivity member 33 is used under such heating conditions, it is possible to effectively heat the liquid L which contains water.

In addition, as described above, the liquid L which is ejected onto the medium M is dried using the blower unit 29 which sends wind W to the liquid L which is ejected onto the medium M. At this time, the blower unit 29 sends the wind W of which an air velocity is 1.0 m/sec to 4.0 m/sec to the liquid L which is ejected from the ejecting unit 3. The air velocity of the wind W causes flight bending, or the like, of the liquid L which is ejected onto the medium M when the air velocity is too strong. On the other hand, when the air velocity is too weak, the effect of drying the liquid L diminishes. Accordingly, it is possible to dry the liquid L while suppressing flight bending of the liquid L which is ejected from the ejecting unit 3, when the blower unit use wind W of which an air velocity is 1.0 m/sec to 4.0 m/sec.

By providing the blower unit 29 in the medium support unit 7, in addition to the low thermal conductivity member 33, it is possible to further effectively fix the liquid L onto the medium M, compared to a case in which only the heating unit is provided.

The entire disclosure of Japanese Patent Application No.: 2013-272554, filed Dec. 27, 2013, and 2014-076757, filed Apr. 3, 2014 are expressly incorporated reference herein.

What is claimed is:

1. A liquid ejecting apparatus comprising:

a medium support unit which includes a supporting face for supporting a medium onto which liquid is ejected;

a heating unit which can heat the liquid which is ejected onto the medium; and a transport unit which transports the medium from an upstream side to a downstream side in a transport direction, wherein the supporting face is configured of a member of which thermal conductivity of at least a part is equal to or smaller than 0.4 W/mK, and wherein the medium support unit includes a first configuration unit in which the member is present, and a second configuration unit which is located on the downstream side of the first configuration unit in the transport direction, and has higher thermal diffusivity than that of the first configuration unit.

2. The liquid ejecting apparatus according to claim 1, wherein the member is present at at least a part of a portion of the supporting face which supports a region in the medium onto which the liquid is ejected.

3. The liquid ejecting apparatus according to claim 1, wherein the member is present at at least a part of a portion of the supporting face which supports a region in the medium heated using the heating unit.

4. The liquid ejecting apparatus according to claim 1, wherein a coefficient of water absorption of the member is equal to or smaller than 0.2%.

5. The liquid ejecting apparatus according to claim 1, wherein a coefficient of dynamic friction of the member is equal to or smaller than 0.4.

6. The liquid ejecting apparatus according to claim 1, wherein a heat-resistant temperature of the member is equal to or greater than 150° C.

7. The liquid ejecting apparatus according to claim 1, wherein a thickness of the member is equal to or greater than 2 mm.

8. The liquid ejecting apparatus according to claim 1, wherein bending strength of the member is equal to or greater than 50 MPa.

9. The liquid ejecting apparatus according to claim 1, wherein compressive strength of the member is equal to or greater than 50 MPa.

10. The liquid ejecting apparatus according to claim 1, wherein the member is formed by laminating a sheet-shaped material which includes a heat curable resin, balloons, and a fibered reinforcing material.

11. The liquid ejecting apparatus according to claim 1, wherein a suction hole for causing a suction force to work on the medium is provided on the supporting face of the medium support unit.

12. The liquid ejecting apparatus according to claim 1, wherein the heating unit heats the liquid ejected onto the medium so as to have a temperature of 35° C. to 60° C.

13. The liquid ejecting apparatus according to claim 12, wherein the heating unit heats the liquid which is ejected onto the medium so as to have a temperature of 40° C. to 55° C.

14. The liquid ejecting apparatus according to claim 1, further comprising:

an ejecting unit which ejects the liquid, wherein the heating unit heats the liquid which is ejected onto the medium so as to be at equal to or lower than a heat-resistant temperature of the ejecting unit.

15. The liquid ejecting apparatus according to claim 1, wherein the heating unit heats the liquid which is ejected onto the medium by radiating electromagnetic waves including a wavelength of at least 2.0 μm to 6.0 μm.

16. The liquid ejecting apparatus according to claim 1, further comprising:

a blower unit which sends wind to the liquid which is ejected onto the medium.

17. The liquid ejecting apparatus according to claim 16, wherein the blower unit sends wind with an air velocity of 1.0 msec to 4.0 msec to the liquid which is ejected onto the medium.

18. A liquid ejecting apparatus comprising:

a medium support unit which includes a supporting face for supporting a medium onto which liquid is ejected; and a heating unit which can heat the liquid which is ejected onto the medium, wherein the supporting face is configured of a member of which thermal conductivity of at least a part is equal to or smaller than 0.4 W/mK, wherein a coefficient of dynamic friction of the member is equal to or smaller than 0.4.

19. A liquid ejecting apparatus comprising:

a medium support unit which includes a supporting face for supporting a medium onto which liquid is ejected;

an ejecting unit which ejects the liquid; and a heating unit which can heat the liquid which is ejected onto the medium, wherein the supporting face is configured of a member of which thermal conductivity of at least a part is equal to or smaller than 0.4 W/mK, wherein the heating unit heats the liquid which is ejected onto the medium so as to be at equal to or lower than a heat-resistant temperature of the ejecting unit.

* * * * *